United States Patent [19]

Gagliano

[11] Patent Number: 4,549,722

[45] Date of Patent: Oct. 29, 1985

[54] JACK ADAPTER FOR CRADLE SUPPORTING OF VEHICLE DIFFERENTIALS AND TRANSMISSIONS

[76] Inventor: Victor Gagliano, 192 Howard Ct. #6, Fox Lake, Ill. 60020

[21] Appl. No.: 617,512

[22] Filed: Jun. 5, 1984

[51] Int. Cl.[4] ..... B66F 3/00

[52] U.S. Cl. ..... 254/134; 254/DIG. 16

[58] Field of Search ..... 254/133, 134, DIG. 16, 254/DIG. 4, 8 B, 8 C, 10 B, 10 C; 269/17, 296, 50, 51

[56] References Cited

U.S. PATENT DOCUMENTS

| | | | |
|---|---|---|---|
| 1,363,020 | 12/1920 | Shewalter | 269/51 |
| 2,500,666 | 3/1950 | Dell | 254/DIG. 4 |
| 2,748,459 | 6/1956 | Orr | 269/296 |
| 2,885,165 | 5/1959 | Smolen | 269/296 |
| 3,136,526 | 6/1964 | Wolf | 254/10 C |
| 3,218,056 | 11/1965 | Kaplan et al. | 269/17 |
| 3,306,601 | 2/1967 | Mitchell | 269/50 |
| 3,851,857 | 12/1974 | Notgrass | 254/134 |
| 4,239,196 | 12/1980 | Hanger | 269/17 |

OTHER PUBLICATIONS

1981 Ford Motor Company Shop Manual pp. 15-15-2 and 15-15-3, including front page of Shop Manual.

*Primary Examiner*—Robert C. Watson

*Attorney, Agent, or Firm*—Hill, Van Santen, Steadman & Simpson

[57] ABSTRACT

An adapter composed of front and rear brackets adjustably mounted on a jack pad has an arcuate recess receiving and supporting the rear flange of a transmission or differential housing and a front bracket with an adjustable plate carrying opposed horizontal straps to be bolted to the front end of the differential or transmission housing and recessed to surround the front end. Bolts sliding in elongated slots accommodate lateral and longitudinal adjustments of the brackets on the jack pad and elevation of a vertical plate carried by the front bracket. A feature of the invention is the rigid mounting support provided for the opposed horizontal straps which prevents shifting of the cradled housing and permits all repair work to be accomplished while a transmission or differential is fixedly supported on the jack.

11 Claims, 3 Drawing Figures

FIG. 1
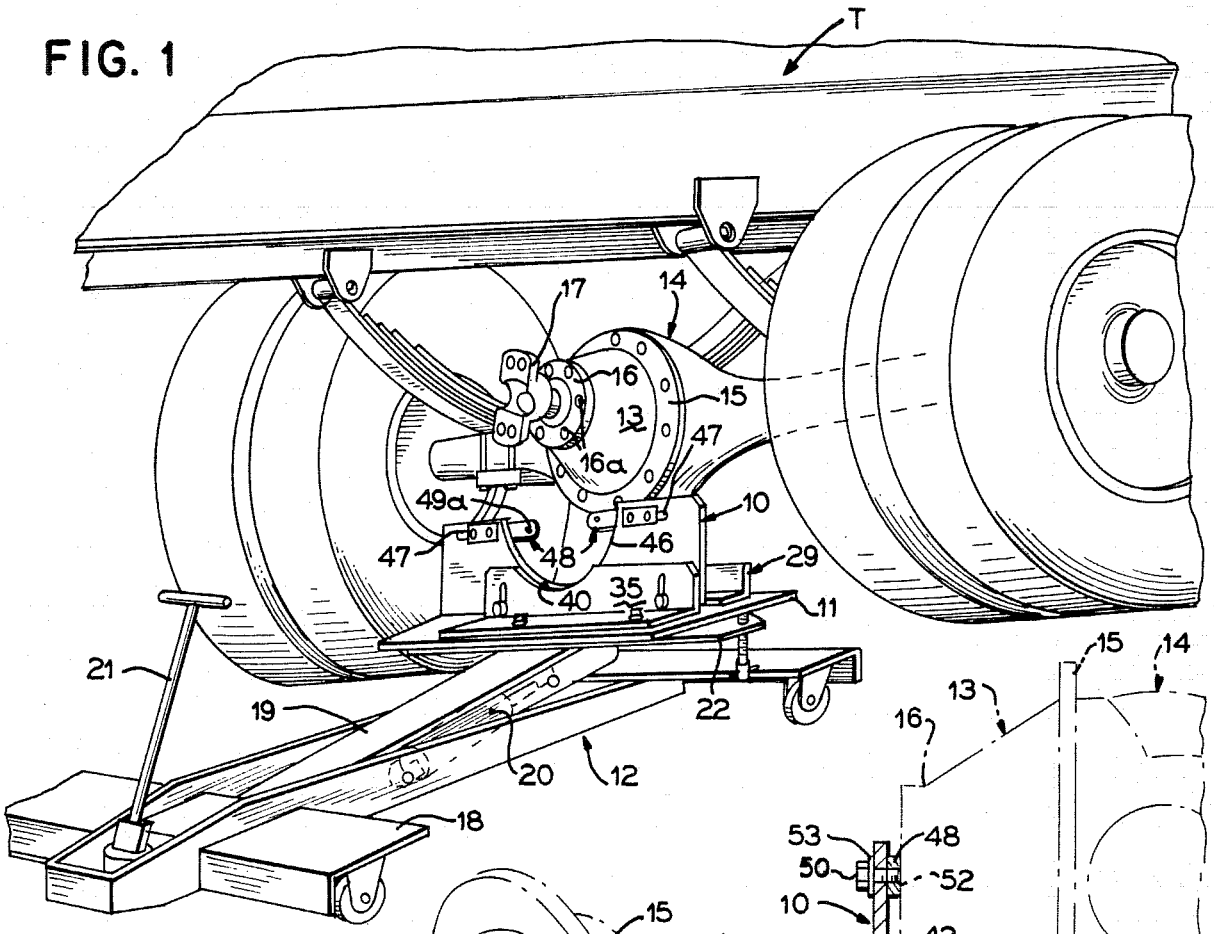
FIG. 2
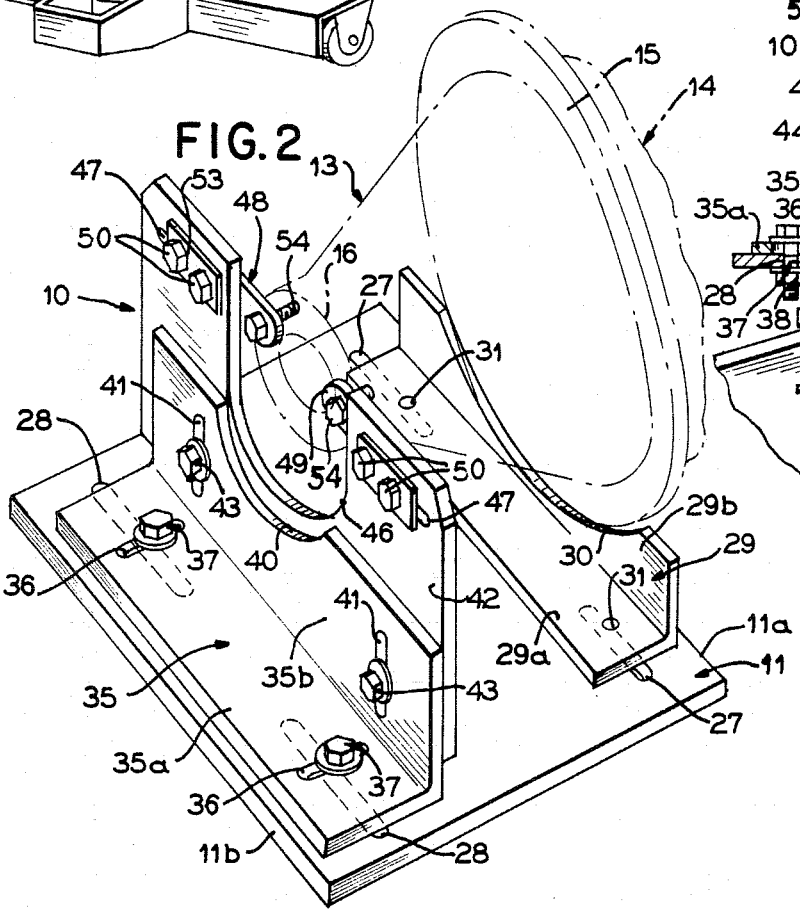
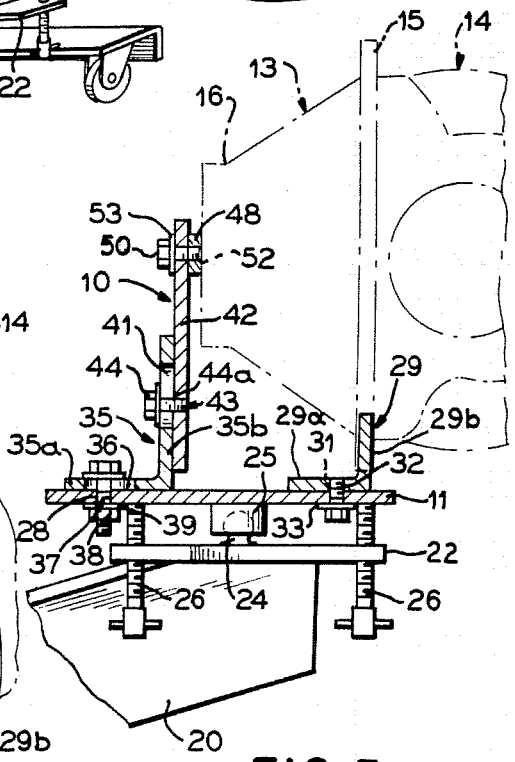
FIG. 3

JACK ADAPTER FOR CRADLE SUPPORTING OF VEHICLE DIFFERENTIALS AND TRANSMISSIONS

FIELD OF THE INVENTION

This invention relates to the art of facilitating removal, repair and replacement of vehicle differentials and transmissions. Specifically, this invention relates to an adapter for mounting on a low level jack pad to cradle support a heavy truck type differential or transmission to facilitate removal, repair, and reinstallation with minimum labor effort.

BRIEF SUMMARY OF THE INVENTION

This invention provides an adapter to be mounted on conventional jacks for cradle supporting differentials and transmissions during removal from automotive vehicles, during repair or servicing of the removed unit, and during reinstallation of the repaired unit. The adapter has front and rear brackets adjustably bolted on the pad of a conventional low level transmission jack. The rear bracket has an arcuately recessed top edge to support the rear end of a differential or transmission housing. The front bracket has a vertically adjustable plate with a central recess for embracing the front end of the differential or transmission housing. The plate carries a horizontal rigid strap on each side of the recess. The inner ends of the straps are adapted to project into the recess and receive bolts which are threaded into the front end of the differential or transmission housing. These straps are secured to the plate in a manner which prevents swinging so that the front end of the housing to which they are bolted cannot shift and the rear end of the housing will be fixedly cradled on the rear bracket thereby avoiding heretofore required use of chains, swinging lugs and the like retainers.

To remove a heavy differential or transmission from a truck or the like the adapter brackets are placed over slots in the front and rear ends of the jack pad, the jack is positioned under the truck raised up to level of the differential or transmission, its pad is leveled therewith, the rear bracket on the pad is shifted as necessary to receive the rear end of the differential or transmission housing in the recess thereof resting on the arcuate top edge of the bracket. The bracket is then secured to the jack pad. The front bracket is adjusted to align the recessed plate thereon with the front end of the differential or transmission housing, and the plate is raised to position the straps over diametrically opposite bolt holes in the front end of the housing. The straps are bolted to this front end and secured to the plate, the plate is secured to the bracket, and the bracket is secured to the jack pad. The differential or transmission housing is then firmly cradled on the jack pad so that it can be easily unbolted and retracted from its mounting, with the jack being manipulated to carry it out from under the truck to a work station where it can be raised to a conventional height for servicing the components and then positioned back under the truck for reinstallation. The entire operations are easily handled by a single operator with no lifting effort being required and with all disassembling, repair, and reinstallation steps being accomplished while the transmission or differential remains fixedly secured to the jack.

It is, therefore, an object of this invention to facilitate removal, repair and reinstallation of heavy vehicle differentials and transmissions.

Another object of this invention is to provide an adapter for transmission jacks which will cradle support differential and transmission housings in fixed position on the jack.

A specific object of the invention is to provide an adapter for use with a low level transmission jack having a support pad with slots in the front and rear ends thereof receiving fasteners from front and rear brackets with recesses for embracing the front and rear ends of the transmission or differential housing and with horizontal straps fixedly securing one end of the housing to a bracket.

Other and further objects of this invention will be apparent to those skilled in this art from the following detailed description of the annexed sheet of drawings.

BRIEF DESCRIPTION OF THE DRAWINGS

FIG. 1 is a perspective view of the adapter of this invention mounted on a low level hydraulic jack being moved into position under the differential of the rear axial drive of a truck.

FIG. 2 is a perspective plan view of the adapter of this invention mounted on a jack pad and illustrating in dotted lines in the manner in which the adapter cradle supports the differential housing of FIG. 1.

FIG. 3 is a longitudinal cross-sectional view of the adapter of this invention mounted on the pad of a low level jack and illustrating in dotted lines in the manner in which the differential housing is fixedly secured to the pad.

DETAILED DESCRIPTION OF THE DRAWINGS

In FIG. 1, the reference numeral 10 designates in general the adapter of this invention mounted on the pad 11 of a low level jack 12 positioned under the differential housing 13 of the rear axle 14 of a truck T. The differential 13 has a large diameter generally circular rear flange 15 bolted to the front face of the banjo housing of the truck rear axle 14. The front end of the differential 13 has a small diameter circular flange 16 from which projects a clevis 17. The clevis 17 has been separated from the coupling to the drive shaft (not shown).

The jack 12 is of a conventional low level hydraulic type with a wheeled frame 18, a lift arm 19 pivoted to the front end of the frame, and a hydraulic jack 20 under the arm 19 actuated by swinging the jack handle 21 to pump fluid for raising and lowering the arm 20. The rear end of the arm 20 has a fixed transverse plate 22, better shown in FIG. 3, where an upstanding ball stud 24 at the center thereof is seated in a socket 25 on the bottom face of the jack pad 11. A plurality of stud bolts 26 threaded through the plate 22 engage the underface of the pad 11 to control the attitude of the pad relative to the plate 22. Thus, the ball and socket connection between the plate 22 and the pad 11 accommodates swivelling of the pad on the plate and the leveling bolts 26 can adjust the attitude of the pad relative to the plate.

The pad 11, as best shown in FIG. 2, has a rear end **11*a* with a pair of transverse slots 27 adjacent to and parallel with this end. The pad 11 also has a front end 11*b* and elongated slots 28 adjacent to and parallel with this end 11*b***.

The adapter 10 of this invention includes a rear angle bracket 29 with a horizontal leg **29*a* overlying the slots 27 of the pad 11 and with an upstanding leg 29***b* projecting upwardly from the rear end 11*a* of the pad. This upstanding leg 29*b* has an arcuate central recess 30 providing a top edge for receiving and supporting the flange 15 of the differential 13. Internally threaded circular bolt holes 31 are provided in the horizontal leg 29*a* of the bracket 29*a* to register with the slots 27. As shown in FIG. 3, bolts such as 32 have heads bottoming on the underface of the pad 11, preferably through washers 33 with shanks extending through the slots 27 and threaded into the tapped holes 31 for fixedly securing the bracket 29 to the pad 11. It will, of course, be understood that these bolts 32 can be loosened to accommodate transverse sliding of the bracket 29 on the pad 11 for aligning the recess 30 with the flange 15 of the differential 13. Lateral adjustment of the bracket 29 is thus provided.

The adapter 10 has a second angle bracket 35 with a horizontal leg 35*a* overlying the slots 28 and with an upstanding vertical leg 35*b* projecting above the pad 11.

The horizontal leg 35*a* has front to rear slots 36 registering with the transverse slots 28. Bolts 37 have heads and washers overlying the slots 36 with shanks projecting through the slots and also through the slots 28 of the pad 11 to receive nuts 38 and washers 39 underlying the pad 11. The bolts 37 and the cooperating slots 28 and 36 through which they extend accommodate shifting of the bracket 35 laterally and also in a front to rear direction to accurately position it under the front end of the differential 13 as will be more fully hereinafter described.

The upstanding vertical leg 35*b* of the bracket 35 has a central fragmental cylindrical recess 40 in its top edge. Upstanding slots 41 are provided in this leg 35*b* on opposite sides of the recess 40.

A vertical plate 42 slidably abuts the rear face of the leg 35*b* and is connected thereto by bolts 43 having heads 44 bottomed on the leg 35*b* and shanks 44*a* extending through the slots 41 and threaded into threaded bolt holes in plate 42 for securing the plate in adjusted vertical position on the leg 35*b*.

The plate 42 has an open top U-shaped recess 46 registering with recess 40 of the bracket leg 35*b*. An elongated horizontal slot 47 is provided through the plate 42 on each side of the recess 46 adjacent the top edge of the plate.

A rigid strap 48 overlies each slot 47. Each strap has an inner end 49 adapted to project into the recess 46. A bolt hole 49*a* is provided through each end 49.

A pair of bolts 50 extend through each slot 47 and through internally threaded tapped holes 52 in the strap 48. A washer bar 53 freely receives the shanks of the bolts and overlies the slot 47 on the front face of the plate 42. The two bolts for each strap 48 prevent rotation of the straps and hold them in fixed horizontal paths along the length of the slot 47.

The brackets 29 and 35 and the plate 42 are preferably made from ½ inch thick case hardened steel. In a typical heavy duty adapter the brackets are about 15–20 inches long, the plate 42 may be longer to project beyond the bracket 35 to provide ample areas for elongated slots 47. In some arrangements the recesses in this plate and bracket are offset from the centers to accommodate different slot arrangements in the jack pad 11. The horizontal legs 29*a* and 35*a* of the brackets are about 3 to 5 inches wide to afford good area contact with the jack pad. The height of the leg 29*b* of the rear bracket is about 3 to 5 inches while the leg 35*b* is higher being of the order of 5–8 inches affording a good flat expanse for seating the plate 42 which may be about 8–15 inches high.

The thickness of the rear bracket affords a wide top edge margin for receiving the peripheral edge of the differential flange 15.

The plate 42 is adjusted on the leg 35*b* of the bracket 35 to position the straps 48 level with a pair of selected diametrically opposite bolt holes 16*a* of the front flange 16 of the differential 13. Then the straps are moved into the recess 46 to align the holes 49*a* with these diametrically opposite bolt holes. Bolts 54 inserted through the holes 49*a* are then threaded into the bolt holes 16*a* and the front end flange 16 of the differential 13 is thereupon rigidly and fixedly secured to the adapter with the periphery of the rear flange 15 seated in the arcuate cradle 30.

Bolts around the periphery of the flange 15 are removed to free the differential 13 from the rear axle 14 whereupon the jack is pulled to extract the differential from the rear axle. The jack is then lowered to clear any overlying truck structure, is pulled out from under the truck, moved to a work station and raised to a convenient height for presenting the components of the differential to a mechanic for inspection and repair. All of the repair and inspection operations are conducted while the differential remains fixedly secured to the jack and upon completion of any repair work, the jack is again lowered, moved under the truck and positioned in alignment with the rear axle so that it can be easily raised to present the bolt holes in the rear flange 15 to the bolt receiving holes in the rear axle 14. The flange is then secured to the axle, the straps are uncoupled from the front flange 16, the jack lowered and moved from under the truck body whereupon the clevis 17 is reattached to the drive shaft and the front flange 16 is bolted in position.

It will be understood that the jack pad 11 is positioned by the studs 26 to any desired attitude relative to the jack plate 22 to facilitate alignment with the differential.

While the adapter 10 has been specifically described for use in cradling a differential, it is of course to be understood that it is used in a similar manner with transmissions.

From the above description, it will be understood to those skilled in this art that the adapter of this invention is easily mounted on the pad of a conventional jack, is easily and quickly adjusted into position for cradling a heavy differential or transmission and securely and stably mounts the cradled body so that it can be retracted from its mounting, moved to a repair station, held by the jack in a desired position for repair and then returned for reinstallation.

I claim:

1. An adapter for use with a low level jack having a support pad with slots in the front and rear ends thereof to cradle and support vehicle transmissions and differentials during removal from the vehicle, repair away from the vehicle, and reinstallation on the vehicle which comprises a rear angle bracket having an upstanding leg with an open top recess for embracing the rear end of a transmission or differential housing and a horizontal leg for resting on the rear end of the pad, a front angle bracket having a vertically slotted upstanding leg and a horizontal leg for resting on the front end of the pad, fasteners extending through the slots of the pad and through the horizontal legs of the angle brackets to selectively position and secure the brackets on the pad, an upstanding plate slidable on the upstanding leg of the front bracket having an open top recess for receiving the front end of a transmission or differential housing, fasteners extending through the slots of the upstanding leg of the front bracket securing the plate to the bracket and accommodating raising and lowering of the plate, said plate having a horizontal slot on each side of the recess adjacent the top of the plate, a rigid horizontal strap overlying each horizontal slot of the plate on each side of the recess, each strap having an apertured inner end for projecting into said recess adapted to receive bolts secured in the front end of the transmission or differential housing, a pair of fasteners extending through each horizontal slot of the plate and through the overlying strap locking said strap on said upstanding plate, said rear bracket being shiftable laterally of said pad, said front bracket being shiftable transversely and laterally of said pad whereby the jack pad can be lifted adjacent the differential or transmission and the brackets thereon shifted to receive the front and rear ends of the transmission or differential housing in the recesses thereof, the straps adjusted to receive bolts from the front end of the housing in the apertured ends thereof and then fixedly secured to the upstanding plate in horizontal position, the housing uncoupled from the vehicle, the jack lowered with the housing thereon to clear the vehicle for transport to a work station to present a transmission or differential to a worker for servicing and the jack replaced under the vehicle to present the housing in position for reinstallation.

2. The adapter of claim 1 including a ball and socket joint connecting the support pad to the jack and means adjusting the attitude of the pad relative to the jack.

3. The adapter of claim 1, wherein the support pad is tiltably mounted on the jack and leveling studs control the attitude of the pad relative to the jack.

4. The adapater of claim 1, wherein the fasteners extending through the slots of the upstanding leg of the front bracket are threaded into tapped holes of the plate.

5. The adapter of claim 1, wherein the open top recess of the rear angle bracket has a thick edge for supporting the periphery of the rear flange of a differential housing.

6. The adapter of claim 5, wherein the jack pad has elongated slots receiving the fasteners.

7. An adapter for mounting on a jack pad to cradle support a vehicle differential or transmission during removel from the vehicle, during repair away from the vehicle, and during reinstallation on the vehicle which comprises front and rear angle brackets having horizontal and vertical legs, fasteners adjustably securing the horizontal legs of the brackets to the jack pad, said vertical leg of the rear bracket having an open top recess shaped to cradle support the rear end of a differential or transmission housing, a vertical plate slidable on the vertical leg of the front bracket having an open top central recess adapted to be aligned with the front end of the differential or transmission housing when the rear end of the housing is cradle supported in the open top recess of the rear bracket, rigid straps slidable endwise on a face of said plate on opposite sides of the central recess to project inwardly beyond said sides of the recess, means holding the straps against swinging on the plate when sliding endwise, the inner ends of said straps being adapted to receive bolts secured in the front end of the differential or transmission housing, means tightening said straps against sliding on the plate, fasteners adjustably securing the plate to the vertical leg of the front bracket, and means for mounting the jack pad on a jack.

8. The adapter of claim 7, wherein the jack pad has a ball and socket connection with the jack.

9. An adapter for cradle supporting a vehicle differential housing or the like on a wheeled jack having a plate adapted to be positioned under the differential housing on the vehicle for supporting the housing during removal from the vehicle, during repair of the differential away from the vehicle, and during reinstallation of the housing on the vehicle, said adapter comprising a pad swivelly mounted on said jack plate, means adjusting the attitude of the pad relative to the plate, a pair of angle brackets having horizontal legs adjustably mounted on the pad and upwardly extending vertical legs, the vertical legs of one of said brackets having a central recess adapted to receive and support one end of the differential housing, a vertical plate slidably on the vertical leg of the other bracket, fasteners adjustably securing the plate at a selected height on said vertical leg, said plate having a central recess, diametrically opposite straps slidable endwise on said plate on opposite sides of said recess and adapted to project inwardly beyond said sides, said straps having bolt holes at their inner ends adapted to receive bolts secured in the front end of the differential housing, means holding said straps against swinging on said plate, and means fixedly securing said straps to said plate on opposite sides of the front end of the differential housing.

10. The adapter of claim 9, including pairs of fasteners holding the horizontal legs of the brackets across the jack pad.

11. An adapter for mounting on a jack pad to cradle support a vehicle differential or transmission which comprises front and rear angle brackets having horizontal and vertical legs, fasteners adjustably securing the horizontal legs of the brackets to the jack pad, an open top recess in the vertical leg of the rear bracket shaped to cradle support the rear end of a differential or transmission housing, a vertical plate slidable on the vertical leg on the front bracket having an open top central recess adapted to receive the front end of the differential or transmission housing, horizontal straps slidable on the plate to project into the central recess, fasteners including washer bars and bolts holding the straps against swinging movement relative to the plate for securing the straps in horizontal position on the plate, the inner ends of said straps being adapted to receive bolts securing in the front end of the differential or transmission housing, fasteners adjustably securing said plate to the vertical leg of said front bracket, and means for mounting said pad on a jack.

* * * * *